United States Patent [19]

Mehl

[11] 4,325,045

[45] Apr. 13, 1982

[54] DEVICE FOR PROVIDING WINDINGS ON CLOSED RING CORES

[75] Inventor: Siegfried Mehl, Wetzlar-Hermannstein, Fed. Rep. of Germany

[73] Assignee: U.S. Philips Corporation, New York, N.Y.

[21] Appl. No.: 173,222

[22] Filed: Jul. 28, 1980

[30] Foreign Application Priority Data

Aug. 2, 1979 [DE] Fed. Rep. of Germany ..... 2931362

[51] Int. Cl.[3] ..... H01F 27/30

[52] U.S. Cl. ..... 336/197; 29/605; 336/198; 336/213

[58] Field of Search ..... 336/15, 198, 105, 107, 336/208, 213, 196, 197; 29/605, 606, 602 R

[56] References Cited

U.S. PATENT DOCUMENTS

| | | | |
|---|---|---|---|
| 862,361 | 8/1907 | Thompson | 336/15 X |
| 1,004,102 | 9/1911 | Storer | 336/15 |
| 3,419,833 | 12/1968 | Vigreux | 336/15 |
| 3,614,692 | 10/1971 | Rozelle | 336/15 |

FOREIGN PATENT DOCUMENTS

| | | | |
|---|---|---|---|
| 266780 | 11/1911 | Fed. Rep. of Germany | 336/15 |
| 1424518 | 12/1965 | France | 336/198 |

*Primary Examiner*—Thomas J. Kozma

*Attorney, Agent, or Firm*—Thomas A. Briody; Robert T. Mayer; Bernard Franzblau

[57] ABSTRACT

A device for providing closed ring cores with windings. A coil former is rotatably arranged on at least one core leg. Between the coil former and the leg there is provided a guide member which is secured to the leg and which comprises guide paths for the coil former rotatably arranged thereon. The coil former is fixed in position after a coil is wound thereon.

11 Claims, 4 Drawing Figures

DEVICE FOR PROVIDING WINDINGS ON CLOSED RING CORES

The invention relates to a device for providing windings on closed ring cores in which a coil former is rotatably arranged on at least one core leg.

German Offenlegungsschrift No. 19 16 637 describes a method of providing windings on closed ring cores where a coil former can rotate around a ring core leg, the copper wire to be wound being wound onto the coil former during the rotation. In order to ensure failure-free execution of this winding method, the coil former may not be hooked behind the iron of the leg. This implies very narrow manufacturing tolerances of the coil former and a complex and time-consuming adjustment of the journalling of the coil former. It is expensive to satisfy these requirements. Keeping the coil former accurately within narrow tolerances, for example, necessitates frequent changing of tools.

The invention has for an object to provide a device which enables failure-free rotation of a coil former around a leg of a ring core.

In a device of the kind described this is realized in accordance with the invention in that between the coil former and the leg a guide member is provided which is mounted on the leg and which comprises guide paths for the coil former arranged thereon.

The guide paths on the guide member and the coil former ensure that the coil former is suitably journalled on the leg so that it is now unimportant how the leg itself is shaped. The tolerances of the coil former and the core leg may also be larger with such a guide.

In a further embodiment of the invention, the guide consists of a guide body consisting of several parts. The guide is then composed of either two shell halves or two rings, each of which comprises complementary ring halves, and with said rings situated at the level of the coil former flanges.

In a further embodiment in accordance with the invention, parts on the inner side of the guide are adapted to the shape of the leg so that they are secured to the leg so as to be blocked against rotation.

In a further embodiment in accordance with the invention, the guide is made of metal. Particularly favourable sliding properties are thus obtained.

Finally, in another embodiment in accordance with the invention the coil former which is rotatable on the guide can serve as a guide for a second coil former arranged thereon.

Figure 1:
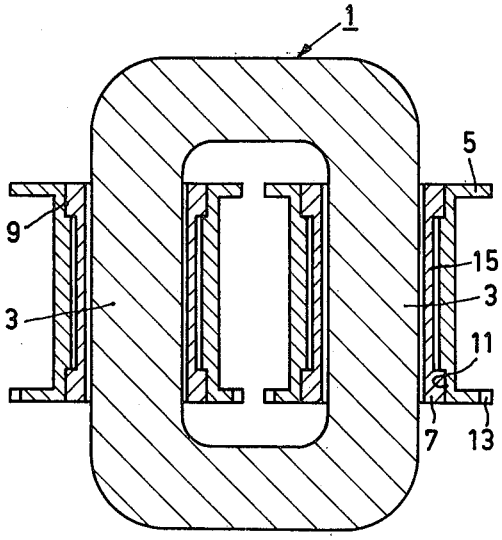
Figure 3:
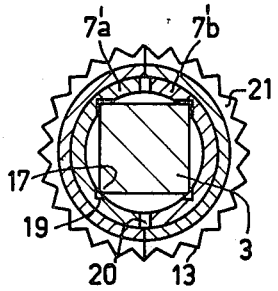
Figure 2:
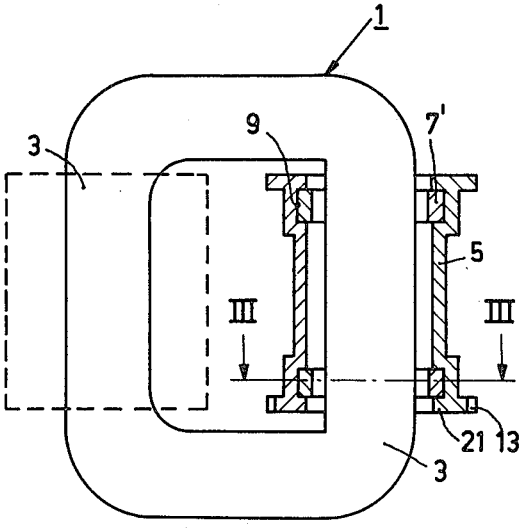
Figure 4:
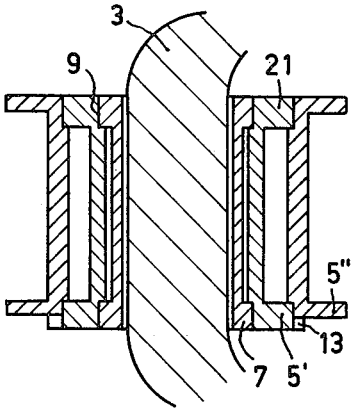

An embodiment in accordance with the invention will be described in detail hereinafter, by way of example, with reference to the accompanying diagrammatic drawing, in which FIG. 1 shows a ring core for a ring core transformer with coil formers arranged on the closed ring core, FIG. 2 shows an alternative embodiment of FIG. 1, comprising smaller guide bodies, FIG. 3 is a sectional view, taken along the line III—III in FIG. 2, of a leg of the ring core, and FIG. 4 shows another embodiment comprising coil formers which are rotatable one over the other.

The ring core shown in FIG. 1 is a winding core wound from metal tape. The ring core 1 is an integral unit. The core comprises two parallel long legs 3 on which there are provided coil formers 5. The coil formers 5 consist of two parts and comprise self-locking snap locks which keep the coil former halves together to form one coil former after they are pressed together.

Between the coil formers 5 and the iron of the legs 3 there are provided guide shells 7 made of metal. These guide shells 7 also consist of two parts and are combined underneath the coil formers 5 to form sleeve-shaped guide bodies which enclose the iron of the leg 3. By adaptation of the guide shells 7 to the shape of the leg 3, the guide shells can be secured to the iron of the legs 3 so that they cannot rotate. FIG. 3 shows a possibility in this respect.

The guide shells comprise annular paths 9 along which corresponding annular faces 11 of the coil bodies 5 can extend. The sliding effect of the coil former 5 across the guide shell 7 can be further improved by a suitable choice of the material and a suitable lubrication.

One flange of the coil former 5 is provided with teeth 13 which can be engaged by the teeth of a drive mechanism. The desired copper winding can be deposited on the coil former 5 by rotation.

FIG. 2 shows an alternative embodiment of the device, the ends of the guide shells 7 no longer being interconnected by means of a connection portion 15. The coil former 5 is in this case rotatable over two guide rings 7' which are arranged in the vicinity of the flanges and which may again be made of metal. The guide rings 7', together forming the guide again, consist of two half rings *7'a* and *7'b* (FIG. 3). The exterior of the guide rings is smooth and the interior of the guide rings is proportioned so that they bear against the sharp edges 17 of the iron of the leg 3 so that they cannot rotate. The blocking of the rings can be achieved, for example, by providing the guide rings *7'a* and *7'b* with grooves 19 whereby the rings engage the edges 17 of the iron of the legs 3. The protection against rotation is thus substantially enhanced. Grooves 19 of this kind can also be provided in the guide shells 7 of FIG. 1 in the same manner. The guide body halves (7, *7'a*, *7'b*) should be electrically insulated from each other by means of an insulating layer 20 in order to prevent the formation of a short-circuited winding which could cause short-circuit currents in the guide bodies.

The device is preferably mounted so that the guide rings shown in the FIGS. 2 and 3 or the guide shells 7 are inserted in the coil halves, a given adherence being obtained, for example, by means of grease. During the mounting of the coil halves, the guide shells 7 or the guide rings 7' are automatically arranged around the iron of the legs. Because they cannot rotate on the iron of the legs, the guide shells 7 or the guide rings 7' form a sliding bearing for the coil bodies 5 which are rotatably arranged on the shells or the rings.

FIG. 4 shows a further embodiment in accordance with the invention where, for example, primary and secondary coils can be wound one over the other. On the iron of the leg 3 there are again provided guide shells 7 around which the coil former 5' can rotate. The coil former 5' comprises flanges 21 arranged so that a further coil former 5'' can be rigidly mounted thereon. The coil former 5'' again consists of two halves which snap one into the other when mounted on the leg 3 and which form a fixed coil former unit in conjunction with and on the coil former 5'.

The provision of windings on the leg 3 shown in FIG. 4 is realized so that first the coil former 5' is rotated and the required number of copper wire turns is provided thereon. Subsequently, the coil former 5'' is arranged thereon; so that, during further rotation of coil former 5' on the guide member, the coil former 5 takes up the second winding, for example, a secondary winding. Thus the coil former 5'' rotates along with the coil former 5' and, consequently, the coil former 5'' also rotates around the leg 3 of the C-core. After termination of the winding of the coil formers, they are glued onto the guide body 7.

Similarly, after the winding, the coil formers are also glued onto the guide rings 7'.

What is claimed is:

1. An induction device comprising, a closed ring magnetic core having at least one core leg, a guide member secured to said core leg and having guide paths on an exposed surface thereof, a coil former rotatably arranged on said core leg in cooperative relationship with the guide paths on said guide member, a coil formed on said coil former by rotation of the coil former in said guide paths, and means for securing the coil former in a fixed position subsequent to winding the coil thereon.

2. A device as claimed in claim 1, characterized in that the guide member comprises two half shells.

3. A device as claimed in claim 1 wherein the coil former includes at least one flange and the guide member includes two axially spaced rings each comprising complementary ring halves situated in the vicinity of the coil former flange.

4. A device as claimed in claim 1 wherein internal parts of the guide member are adapted to the shape of the core leg whereby they are mounted on the core leg so that they cannot rotate.

5. A device as claimed in claim 1 wherein the guide member is made of metal and comprises two guide halves electrically insulated from each other by means of an insulating layer.

6. A device as claimed in claims 1, 3, 4 or 5 further comprising a second coil former supported by the first coil former and rotatable about the core leg to form a second coil mounted on the second coil former by rotation of the second coil former relative to the core leg, and means for securing the second coil former in a fixed position subsequent to winding the second coil thereon.

7. A device as claimed in claim 1 wherein said guide member is arranged to serve exclusively as a guide for the rotation of the coil former.

8. A device as claimed in claim 1 wherein the guide member is made of a metal material.

9. A device as claimed in claims 1 or 8 wherein the guide member comprises two axially spaced rings.

10. A device as claimed in claim 1 wherein the ring core comprises a wound metal tape.

11. A method of forming an induction device which comprises, securing a guide member about one leg of a closed ring magnetic core, rotatably mounting a coil former on said guide member, forming a coil on said coil former by rotating the coil former so as to wind a coil thereon, and securing the coil former in a fixed position subsequent to formation of the coil thereon.

* * * * *